United States Patent [19]

Kneissl

[11] 4,154,459

[45] May 15, 1979

[54] TOP SURFACE EDGES FOR A SKI OF PLASTIC MATERIAL

[75] Inventor: Franz Kneissl, Kufstein, Austria

[73] Assignee: Franz Kneissl Skifabrik Gesellschaft m.b.H., Kufstein, Austria

[21] Appl. No.: 815,156

[22] Filed: Jul. 13, 1977

[30] Foreign Application Priority Data

Jul. 22, 1976 [AT] Austria ..... 5392/76
Mar. 3, 1977 [AT] Austria ..... 1415/77

[51] Int. Cl.[2] ..... A63C 5/12

[52] U.S. Cl. ..... 280/610; 249/96; 280/608

[58] Field of Search ..... 280/610, 608; 249/92, 249/94, 95, 96

[56] References Cited

U.S. PATENT DOCUMENTS

| | | | |
|---|---|---|---|
| 3,535,986 | 10/1970 | Daub | 249/95 |
| 3,807,746 | 4/1974 | Kofler | 280/610 |
| 3,889,918 | 6/1975 | Stoeberl | 249/96 |
| 3,958,810 | 5/1976 | Bohm | 280/608 |

*Primary Examiner*—David M. Mitchell
*Attorney, Agent, or Firm*—John J. Dennemeyer

[57] ABSTRACT

The top surface edges for a ski of plastic material with a foam material core are produced by first placing the structural parts of the ski in position in a mold and thereafter filling the hollow spaces in the closed mold with an expandable synthetic foam material to form the core and set the structural parts of the ski. An auxiliary strip supports the structural parts in the mold and has a flange which extends beyond the side surfaces of the mold. The flange of this auxiliary support strip is extended outwardly a greater distance from the mold side walls and has angled portions which are lodged in a groove in the top edge surface of the mold box to hold the support strip and structural parts of the ski firmly in their proper position during the foam expansion in the mold. The portions of the auxiliary support strip are severed after the ski has been molded.

4 Claims, 12 Drawing Figures

TOP SURFACE EDGES FOR A SKI OF PLASTIC MATERIAL

The basic patent relates to a ski with top surface edges for a ski made of a plastic material provided with a foam material core and produced in a mold into which all the structural parts such as the top and bottom surface sheets, the top surface edges and the like of the ski are inserted, and thereupon the mold is filled with a synthetic foam material, such as polyurethane, which is expanded so as to form the ski core, and the top surface sheet is fixed in place by clamping parts of the ski which project beyond the side surfaces of the finished ski between the upper and lower parts of the separated mold whose separation plane coincides essentially with the top surface sheet of the ski, and after the foam expansion in the mold the parts projecting from the side surfaces of the ski are removed, an auxiliary strip being provided which projects from the side surface of the upper edge located at the side surface of the finished ski and aligned substantially with the top surface sheet located at the top surface of the finished ski.

In order to maintain the top surface edges in the correct position when the mold is open it is necessary to locate, in the case of top surface edges of a non-metallic material, magnets in the lower parts of the mold along the longitudinal side surfaces of the mold interior space at a distance therefrom, and with these magnets small armature plates are associated which reach partly over the auxiliary strip of the ski top surface edge, or in the case of top surface edges of steel the magnets are inserted in the mold surfaces, and similarly for the lower edges.

With this arrangement, disclosed in U.S. Pat. No. 3,958,810, it is possible to fix the top surface edges in the mold in a simple manner in the correct position.

It is now an object of the present invention to improve these known ski top surface edges in the sense that its fixing in the open mold is substantially facilitated.

This is obtained according to the invention in that the auxiliary strip has a projecting leg and that this leg may be inserted in a slot or groove disposed in the separation surface of the lower part of the mold. According to an embodiment of the invention the auxiliary strip is angled off at its free end. According to another embodiment the auxiliary strip presents at a distance from its free end an offset leg. According to a further feature of the invention the leg extends from the free end of the auxiliary strip for a greater distance.

According to the last mentioned embodiment of the invention the free end of the auxiliary strip is beveled in the direction of the leg wherein the bevelled portion merges into the leg.

The angled portion of the auxiliary strip extends preferably over the entire length of the top surface edge. According to an additional feature of the invention the auxiliary strip is subdivided in the longitudinal direction of the top surface edge by transversely extending slots, whereby the ski top edge may adapt easily to the mold. In order to facilitate a severing of the auxiliary strip from the finished ski a weakened area is provided at the connection points between the top surface edges and the auxiliary strip, for example a notch.

With a form of the ski top surface edge according to the invention the correct positioning of these ski top edges, made of any suitable material, is substantially facilitated. A sliding of the top edges made of steel relative to the fixing magnets, as it has occurred before, in U.S. Pat. No. 3,958,810, for example and the mounting of the armature plates for holding down the top edges made of a non-magnetic material is eliminated, whereby a substantial work saving is obtained.

Further details of the invention can be taken from the following description in connection with the accompanying drawing in which.

Figure 11:
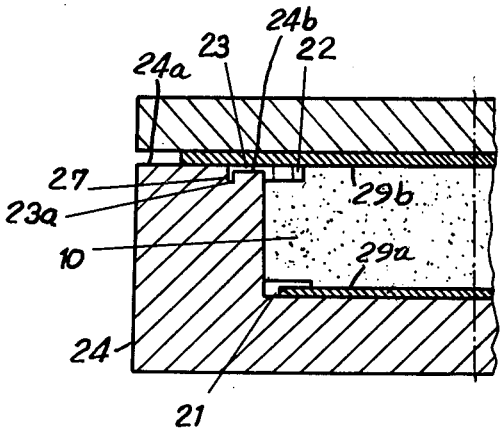
FIGS. 11 and 12 show each a cross-section through two different mold embodiments used for manufacturing a ski with the ski top surface edges according to FIGS. 3 and 1, respectively.
Figure 12:
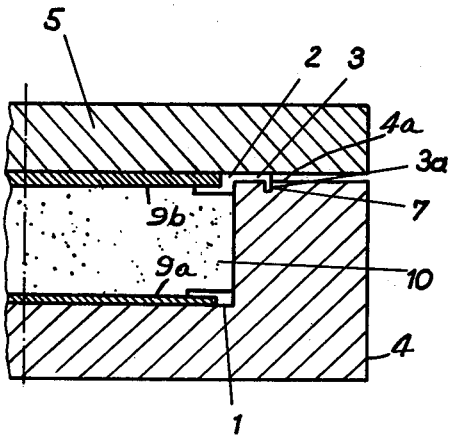

With reference to the drawings the mold for manufacturing a ski of plastic material provided with a foam material core consists of lower mold part or mold box shown at 4 in FIG. 12 and at 24 in FIG. 11, and an upper mold part or mold lid 5 and 25, respectively. The ski run edge 1 and the ski bottom surface sheet 9*a* (run surface) are placed in the mold box 4 or 24. The fixing of the ski run edges 1 and thus also of the bottom surface sheet 9*a* is obtained by magnets, not shown.

Figure 2:
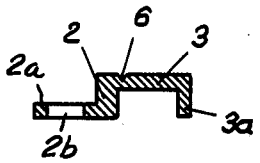
FIG. 2 shows the ski top surface edge of FIG. 1 in cross-section.
Figure 1:
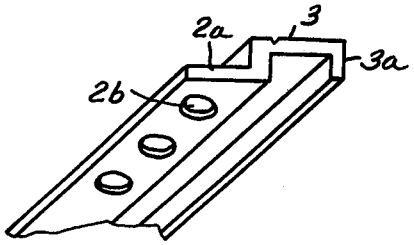
FIG. 1 shows a first modification of an embodiment of the ski top surface edge according to the invention, in a perspective view.

In a first embodiment of the invention, in order to fix the ski top surface edges 2 in the mold 4, they are provided, as shown in FIGS. 1, 2 and 12, with an auxiliary strip 3, wherein the auxiliary strip 3 presents an angled leg portion 3*a*. With the auxiliary strip 3 the ski top surface edges are placed on the separation surface 4*a* of the mold 4 and simultaneously the angled leg portion 3*a* is inserted in a groove 7 provided in said separation surface. In this way the actual top surface edge 2 comes to lie in the hollow space of the mold. Now the top surface sheet 9*b* of the ski can be placed, as shown in FIG. 12, on a recessed ledge 2*a* having holes 2*b* therein and which forms the anchoring strip of the ski top edge 2, and the mold lid 5 is put on. In this way the mold lid provides, in addition to the slot 7, a holding function for the ski top surface edges 2, by clamping the edges 2 and their auxiliary strips 3 between the mold lid 5 and the separation surface 4*a*. The leg portions 3*a* and the grooves 7 are interlocked so that shifting of the top edges 2 and their interconnected strips 3 is prevented, and the ledges 2*a* then support the top surface sheet 9*b*.

Top edges 2 are, of course, provided on both sides of the ski. After the foam expansion of the mold the finished ski is removed from the mold, and the auxiliary strips 3 of the top surface edges 2 which extend from the side surfaces of the ski, are removed. A groove 6 is formed between each edge 2 and its auxiliary strip 3, and forms a break-line to facilitate removal of the strips 3 from the finished ski.

Figure 4:
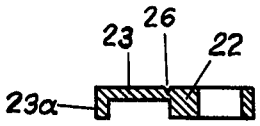
FIG. 4 shows the ski top surface edge of FIG. 3 in cross-section.
Figure 3:
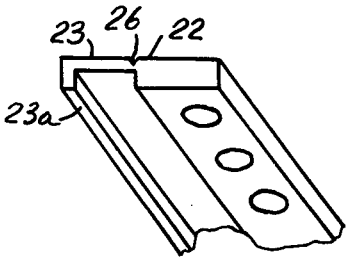
FIG. 3 shows a second modification of the embodiment of the ski top surface edge according to the invention, in a perspective view.

In the embodiment of FIGS. 3, 4 and 11, the recessed ledge 2*a* of FIG. 1 is eliminated. Referring to these Figures, the mold box 24 has a separation surface 24*a* provided with a groove 27, and the portion 24*b* of the separation surface 24*a* inwardly of the groove 27 is recessed by an amount equal to the thickness of the auxiliary strip 23 of the modified top edge 22. The top edge 2 is mounted on the mold box 24 in a manner like the top edge 2 of FIG. 1, the strip 23 carrying an angled leg portion 23*a* that is received in the groove 27. The ski run edge 21 and the ski bottom surface sheet 29*a* are identical to the similar elements of the first embodiment, and are similarly placed in the mold box 24. The top surface sheet 29*b*, however, is wider than the sheet 9*b*, and rests on the planar upper surfaces of the top edge 22 and the strip 23, which are flush with the portion of the separation surface 24*a* located outwardly of groove 27. Like in FIG. 12, the top edge 22 is locked in position against shifting by the interengaged leg 23*a* and groove 27. The top surface sheet 29*b* is clamped in place by the mold lid 25.

After expansion of the material placed in the mold box 24, the laterally extending portions of the top surface sheet 29*b* and the auxiliary strip 23 are both removed. To facilitate removal of the strip 23, a groove 26 is again provided between it and its top edge 22.

Figure 5:
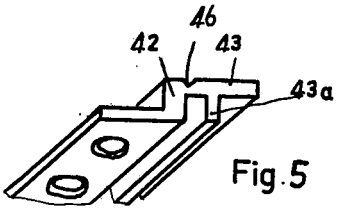
FIG. 5 shows a first modification of the other embodiment of the ski top surface edge according to the invention, in a perspective view.
Figure 6:
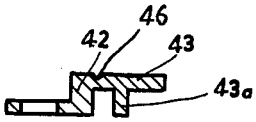
FIG. 6 shows the ski top surface edge according to FIG. 5 in cross-section.

FIGS. 5 and 6 show a modification of the top surface edge and auxiliary strip of FIGS. 1 and 2. Referring to FIGS. 5 and 6, the top edge 42 is again provided with a recessed ledge 42*a*, and carries an auxiliary strip 43, separated therefrom by a break-line groove 46. The auxiliary strip 43 carries and angled leg portion 43*a*, but such is positioned centrally of the strip, rather than at the edge, as in FIGS. 1 and 2. With this arrangement, the auxiliary strip 43 is clamped between the mold components both inwardly and outwardly of the leg portion.

Figure 7:
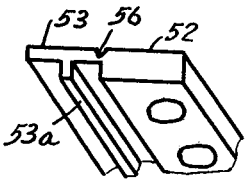
FIG. 7 shows a second modification of the other embodiment of the ski top surface edge according to the invention, in a perspective view.
Figure 8:
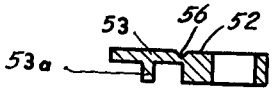
FIG. 8 shows a ski top surface edge of FIG. 7 in cross-section.

Turning now to FIGS. 7 and 8, a modification of the top surface edge 22 and auxiliary strip 23 of FIGS. 3 and 4 is shown, constructed in a manner similar to the embodiment of FIGS. 5 and 6. In FIGS. 7 and 8, the top edge 52 carries the auxiliary strip 53, separated therefrom by the break-line groove 56, and the strip 53 carries a centrally positioned angled leg portion 53*a*.

Figure 9:
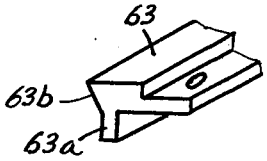
FIG. 9 shows a third modification of the other embodiment of the ski top surface edge according to the invention, in a perspective view.
Figure 10:
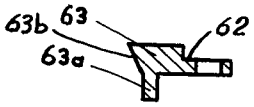
FIG. 10 shows the ski top surface edge of FIG. 9 in cross-section.

Finally, FIGS. 9 and 10 show a top edge 62 having an auxiliary strip 63 provided with an angled leg portion 63*a*, the latter being joined by a beveled surface 63*b* to the top surface of the strip 63.

What is claimed is:

1. In combination:

a mold for use in making a ski of plastic material, said mold including a mold box having a separation surface thereon running along both sides of a mold cavity in which top surface edges, top and bottom surface sheets, running edges, and expandable foam material are placed to make the ski, and a mold lid also carrying a separation surface, the separation surfaces of said mold lid and said mold box being clamped together when making a ski, and said mold box separation surface having a groove therein on each side of and spaced from said mold cavity, said groove being defined by a bottom wall and a pair of spaced, parallel side walls; and a top surface edge and auxiliary strip assembly for use in conjunction with said mold for making a ski, and comprising:

an elongated top surface edge, for forming the top edge of one side of said ski;

an auxiliary strip formed integrally with said top surface edge and projecting laterally therefrom, said auxiliary strip being adapted to be clamped between said separation surfaces of said mold box and said mold lid on the appropriate side of said mold cavity, with said top surface edge disposed in said cavity, said top surface edge and auxiliary strip assembly being adapted to support said top ski sheet; and an angled leg carried by an extending longitudinally of said auxiliary strip and depending downwardly therefrom, said leg being positioned centrally of said auxiliary strip and having parallel side surfaces, and being receivable within the associated one of said grooves in said mold box separation surface with the undersurface of said auxiliary strip in engagement with said mold box separation surface, said parallel side surfaces of said leg being spaced apart a distance only slightly less than the distance measured between said parallel groove side walls, whereby when said leg is engaged in its associated groove with the undersurface of said auxiliary strip in engagement with said mold box separation surface and said auxiliary strip is clamped between said separating surfaces of said mold box and said mold lid both inwardly and outwardly of said leg, said top surface edge and auxiliary strip assembly is secured against lateral shifting relative to said mold box;

said auxiliary strip being joined to said top surface edge by a break-line groove, to facilitate removal of said auxiliary strip from said top surface edge, after the ski is made.

2. In the combination as recited in claim 1, wherein said angled leg is joined to the top surface of said auxiliary strip by a beveled surface, angled outwardly from said leg toward said top surface.

3. In the combination as recited in claim 1, wherein said top surface edge includes a recessed ledge on the inner side thereof, for receiving and supporting said top surface sheet within said mold cavity.

4. In the combination as recited in claim 1, wherein said top surface edge and said auxiliary strip assembly have upper surfaces lying in a common plane, and upon which said top surface sheet is supported, the portion of said mold box separating surface engaged by said auxiliary strip being recessed to a depth corresponding to the thickness of said auxiliary strip, whereby the balance of said separating surface is coextensive with said upper surfaces of said top surface edge and said auxiliary strip.

* * * * *